US005251376A

United States Patent [19]

Althaus et al.

[11] Patent Number: 5,251,376

[45] Date of Patent: Oct. 12, 1993

[54] RAZOR HEAD, ESPECIALLY RAZOR BLADE UNIT OF A WET RAZOR

[75] Inventors: Wolfgang Althaus, Wuppertal; Michael Schwarz, Herne, both of Fed. Rep. of Germany

[73] Assignee: Wilkinson Sword Gesellschaft mit beschränkter Haftung, Solingen, Fed. Rep. of Germany

[21] Appl. No.: 905,405

[22] Filed: Jun. 25, 1992

[30] Foreign Application Priority Data

Jul. 3, 1991 [DE] Fed. Rep. of Germany ... 9108214[U]

[51] Int. Cl.[5] ..... B26B 21/00

[52] U.S. Cl. ..... 30/50; 30/51; 30/57

[58] Field of Search ..... 30/50, 77, 79, 47, 57, 30/51

[56] References Cited

U.S. PATENT DOCUMENTS

| | | | |
|---|---|---|---|
| 3,783,510 | 1/1974 | Dawidowicz et al. | 30/47 |
| 4,063,354 | 12/1977 | Oldroyd et al. | 30/50 |
| 4,257,160 | 3/1981 | Murai | 30/50 |
| 4,300,285 | 11/1981 | Endo | 30/63 |
| 4,461,079 | 7/1984 | Ciaffone et al. | 30/50 |
| 4,501,067 | 2/1985 | Duncan | 30/77 |
| 5,074,042 | 12/1991 | Althaus et al. | 30/50 |

FOREIGN PATENT DOCUMENTS

| | | |
|---|---|---|
| 0312663 | 4/1989 | European Pat. Off. . |
| 3218411 | 5/1982 | Fed. Rep. of Germany . |
| 8910490 | 9/1989 | Fed. Rep. of Germany . |
| 647450 | 1/1985 | Switzerland . |

*Primary Examiner*—Douglas D. Watts
*Assistant Examiner*—Hwei-Siu Payer
*Attorney, Agent, or Firm*—Robert W. Becker & Associates

[57] ABSTRACT

A razor head, especially a razor blade unit of a wet razor, with the razor head being disposed at the front end of a handle. A single or double razor blade is yeildingly mounted in a plastic housing that is provided with a front guide strip. To provide an improved spring or yielding mounting of the single or double razor blades, these blades are secured to a blade member that is pivotably mounted in the plastic housing so as to be pivotable against a spring force about an axis that extends parallel to the guide strip.

15 Claims, 11 Drawing Sheets

RAZOR HEAD, ESPECIALLY RAZOR BLADE UNIT OF A WET RAZOR

BACKGROUND OF THE INVENTION

The present invention relates to a razor head, especially a razor blade unit of a wet or safety razor, with the razor head being disposed at the front end of a handle. A single or double razor blade is spring or yieldingly mounted in a plastic housing that has a front guide strip.

In disposable razors, a single or double razor blade is fixedly embedded in the razor head in a plastic housing. If the razor head is a separate component that can be secured to a handle, for which purpose the handle and the razor head can be interconnected by corresponding securing means, the razor head is known as a so-called razor blade unit.

With one known razor blade unit of a wet razor, a plastic housing is provided with a front guide strip. Two razor blades, to form a double razor blade, are disposed within this plastic housing, with each razor blade being yieldingly mounted. For this purpose, each of the two razor blades is disposed on a lateral spring tongue so that they can each conform to the face contour during a shaving process.

One drawback of this known system is that the angle, and hence the position, of the razor blades does not remain constant during the shaving process. Thus, undesired oscillations or movements can occur in the respective razor blade, and can result in an unsatisfactory shave.

It is therefore an object of the present invention to provide a razor head, and especially a razor blade unit of a wet razor, that has an improved spring or yielding mounting of the single or double razor blades.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
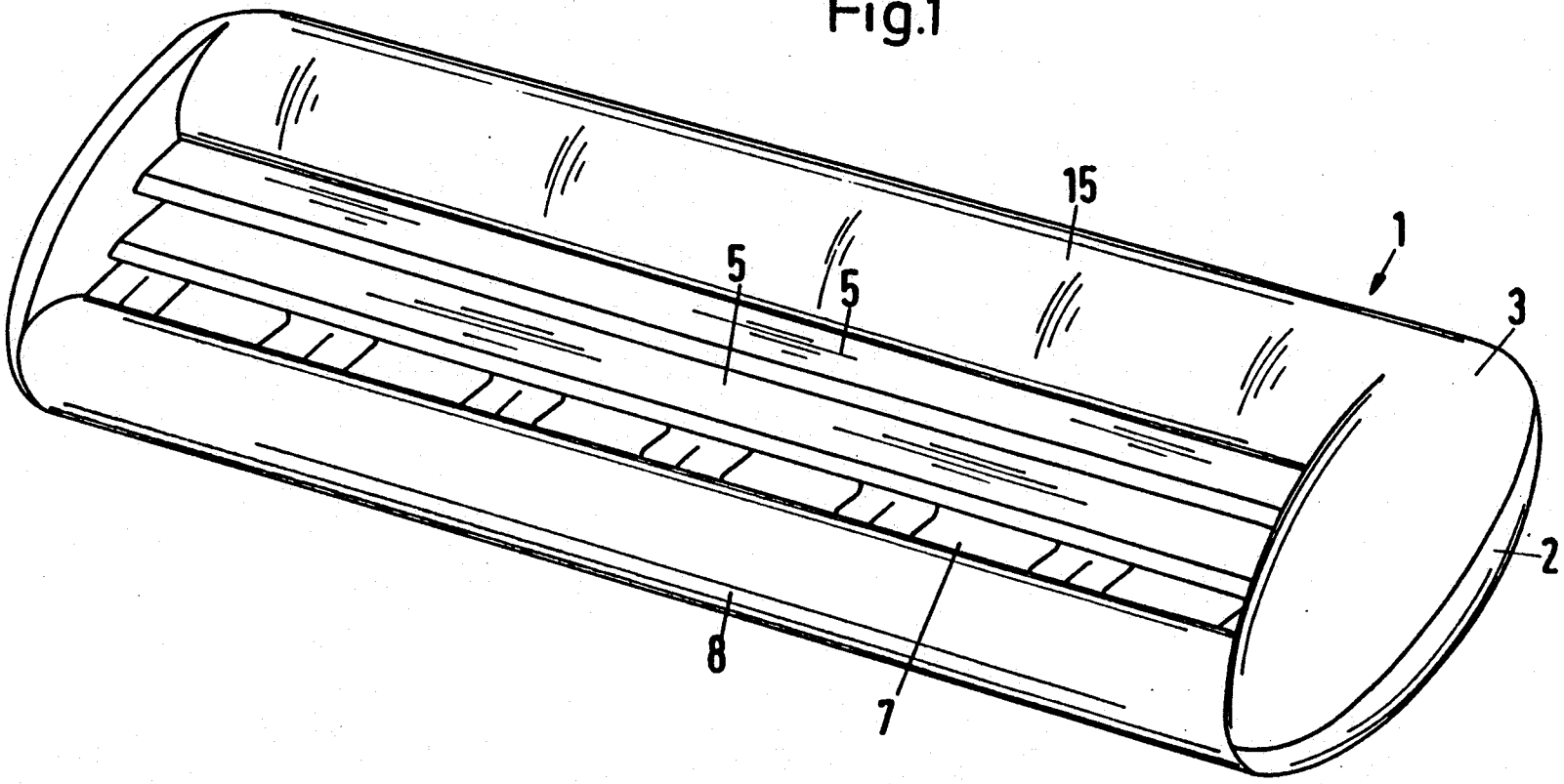
FIG. 1 is a perspective view of a first exemplary embodiment of an inventive razor head in the form of a razor blade unit of a wet razor.
Figure 1A:
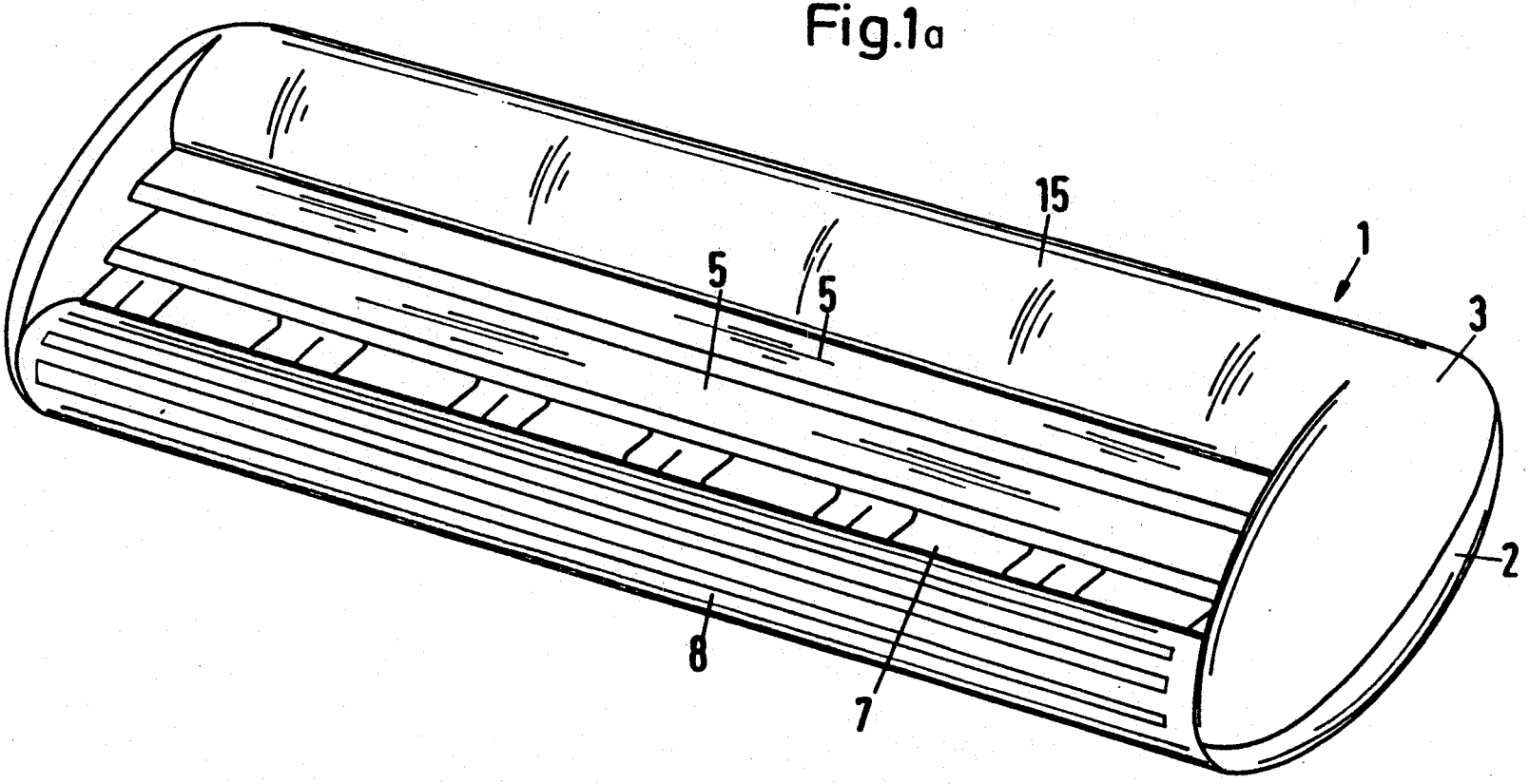
FIG. 1*a* shows an exemplary textured surface for the guide strip.

The razor head of the present invention is characterized primarily in that the single or double razor blade is secured to a blade member that is pivotably mounted in the plastic housing so as to be pivotable counter to the spring force about an axis that extends parallel to the guide strip.

A razor head, especially a razor blade unit of a wet razor, that is constructed pursuant to the teaching of the present invention so that it has a single or double razor blade secured to a blade member has the advantage of providing an improved spring or yielding mounting. For example, when a conventional double razor blade is used the two individual razor blades, which are mounted so as to be parallel to one another, are displaceable in a parallel and hence synchronous manner. The significant advantage of this system is that the angle and hence the position of the razor blades does in fact remain constant while shaving, whereby undesired oscillations or movements in the blades are avoided due to the precise technical guidance, so that as a result an optimum shaving efficiency can be achieved.

The pivot axis is preferably disposed in the vicinity of the guide strip. As a consequence, while shaving the blade member, with the single or double razor blade that is secured thereto, can pivot into the plastic housing.

Pursuant to a first, preferred alternative, the blade member is fixedly connected with the guide strip and the unit formed from the blade member and the guide strip is pivotable about an axis that extends through the guide strip. In this connection, at least that portion of the guide strip that contacts the skin during a shaving process can preferably have a round cross-sectional configuration, through the center of which extends the axis. Furthermore, the guide strip is preferably provided with a structure or texture.

As a consequence, the razor blades that are secured in a parallel manner on the blade member can carry out a pivoting movement about the center of the guide strip. By turning or pivoting the guide strip, it is possible to execute a pivoting of the blade member, which results in the advantage that the operation of the razor blades can be verified. With an appropriate relationship between the bearing surface of the guide strip and the spring, it is possible to achieve a direct deflection of the razor blades since during a shaving process, via the distribution of the forces, a corresponding torque is introduced into the guide strip. Therein lies the essential concept of this embodiment of the inventive razor head. In particular, the guide strip that leads or is ahead of the razor blades assumes an active role in that the guide strip effects a transfer of frictional forces that occur while shaving onto the blade member. The guide strip is thus actively involved in the pivoting of the blade member and hence in the pivoting of the razor blades. The transfer of the forces occurring during the shaving process is improved if the guide strip is provided with a texture. In this connection, the transfer of force is a function not only of the individual shaving conditions but also of the shaving agents that are used.

Pursuant to a second alternative, it is proposed that the blade member be fixedly connected with a strip, and that the unit formed from the blade member and the strip be pivotable about an axis that extends through this strip, which is disposed below a fixed or stationary guide strip. Thus, a portion of the guide strip, namely the upper region of the guide strip, is fixedly formed on the plastic housing, for example on an upper blade shell, while the lower portion of the guide strip is pivotable together with the blade member.

The strip or bar preferably has a partially round cross-sectional configuration such that the axis extends in the center thereof and the outer surface forms an essentially continuous transition relative to the guide strip. As a consequence, an optimum configuration of the guide strip is provided that optimally fulfills the requirements placed thereon.

Pursuant to one specific embodiment of the present invention, the guide strip or the strip of the unit is provided on the sides with pins via which the unit is pivotably mounted in the side walls of the plastic housing. This provides a technically very straightforward possibility for being able to pivotably mount the unit, together with the guide strip or the strip, in the plastic housing.

Pursuant to one specific embodiment, it is proposed that the unit have openings. These openings have the advantage that during the shaving process the shaving cream can pass therethrough for better removal thereof, whereby the lower portion of the plastic housing is provided with corresponding openings or recesses to thereby ensure an unobstructed passage of the shaving cream. Furthermore, the openings facilitate cleaning of the razor head.

Pursuant to a further specific embodiment of the present invention, it is proposed that a compression spring be disposed between the blade member and the base of the plastic housing. Such a compression spring that is supported between the blade member and the base has the advantage that in this way a spring or yielding mounting of the blade member within the plastic housing is ensured in a technically straightforward manner.

The compression spring is preferably a curved leaf-type spring. This spring can, in an appropriately curved manner, be placed into the lower portion of the plastic housing prior to the assembly of the razor head, especially a razor blade unit. The spring can be made of metal or plastic. Instead of a leaf-type spring, the compression spring can also be formed from an appropriately bent wire.

Pursuant to one preferred specific embodiment, the leaf-type spring can have a number of curved portions, i.e. one curved portion follows another. As a consequence, a uniform abutment surface is provided for the blade member.

It would also be conceivable for the razor head to have a push member that extends through the lower housing base, so that the spring component could also be eliminated.

The pivoting movement of the blade member is preferably delimited at the top by a cap or cover means of the plastic housing. In this way, the starting position of the blade member, and hence the starting geometry, is clearly defined.

Pursuant to a further specific embodiment, it is proposed that the plastic housing comprise a lower portion and an upper portion that can be assembled together, with the blade member, possibly with the guide strip or other strip connected therewith, being disposed between these portions as a separate component. The advantage of such a construction is that the razor head, especially a razor blade unit, can be assembled in a technically straightforward manner since it is comprised of only very few individual parts that can be assembled without difficulty.

It is finally proposed pursuant to another specific embodiment that the back side of the blade member be provided with a projection that is guide outwardly through an opening in the rear wall of the plastic housing. This projection is preferably disposed in the central region of the razor head. By means of this projection, the blade member can be easily controlled or actuated from the outside, thereby considerably improving cleaning of the blades.

Further specific features of the present invention will be described in detail subsequently.

DESCRIPTION OF PREFERRED EMBODIMENTS

Referring now to the drawings in detail, FIGS. 1 to 5 illustrate a first exemplary embodiment of the inventive razor blade unit, and FIGS. 6 to 10 illustrate a second exemplary embodiment.

The first embodiment of the razor blade unit illustrated in FIGS. 1 to 5 comprises a plastic housing 1. This plastic housing is composed of a lower portion 2 and an upper portion 3, which can be appropriately placed one upon the other and interconnected, for example by being fused or glued together, by interlocking, by being telescoped into one another, etc.

A blade member 4 is pivotably mounted between the lower portion 1 and the upper portion 3 of the plastic housing 1. Two razor blades 5, to form a double razor blade, are first secured to the blade member 4, for example by being glued thereon or fused therewith. By means of a connecting part 6, which is provided with openings 7, the blade member 4 is integrally connected with a guard or guide strip 8, so that the blade member 4, the connecting part 6, and the guide strip 8 form a unit. As can be seen in particular in the cross-sectional views of FIGS. 4 and 5, the guard or guide strip 8 has a round cross-sectional configuration. Pins 9 are formed onto the ends of the guide strip 8. By means of these pins 9, the unit is pivotably mounted in corresponding recesses 10 in the two side walls 11 of the plastic housing 1.

The blade member 4 is furthermore yieldingly mounted within the plastic housing 1. For this purpose, a compression spring 14 in the form of a leaf-type spring is supported between the underside of the blade member 4 and the base 12 of the lower portion 2 of the plastic housing 1, in an appropriate recessed portion 13. The spring 14 presses the blade member 4 upwardly against a cap or cover means 15 at the upper side of the upper portion 3 of the plastic housing 1. As can be seen from FIG. 2, the compression spring 14 is provided with a number of curved portions, i.e. the spring has two contact points on the base 12 while the blade member 4 rests upon 3 curved portions.

Figure 2:
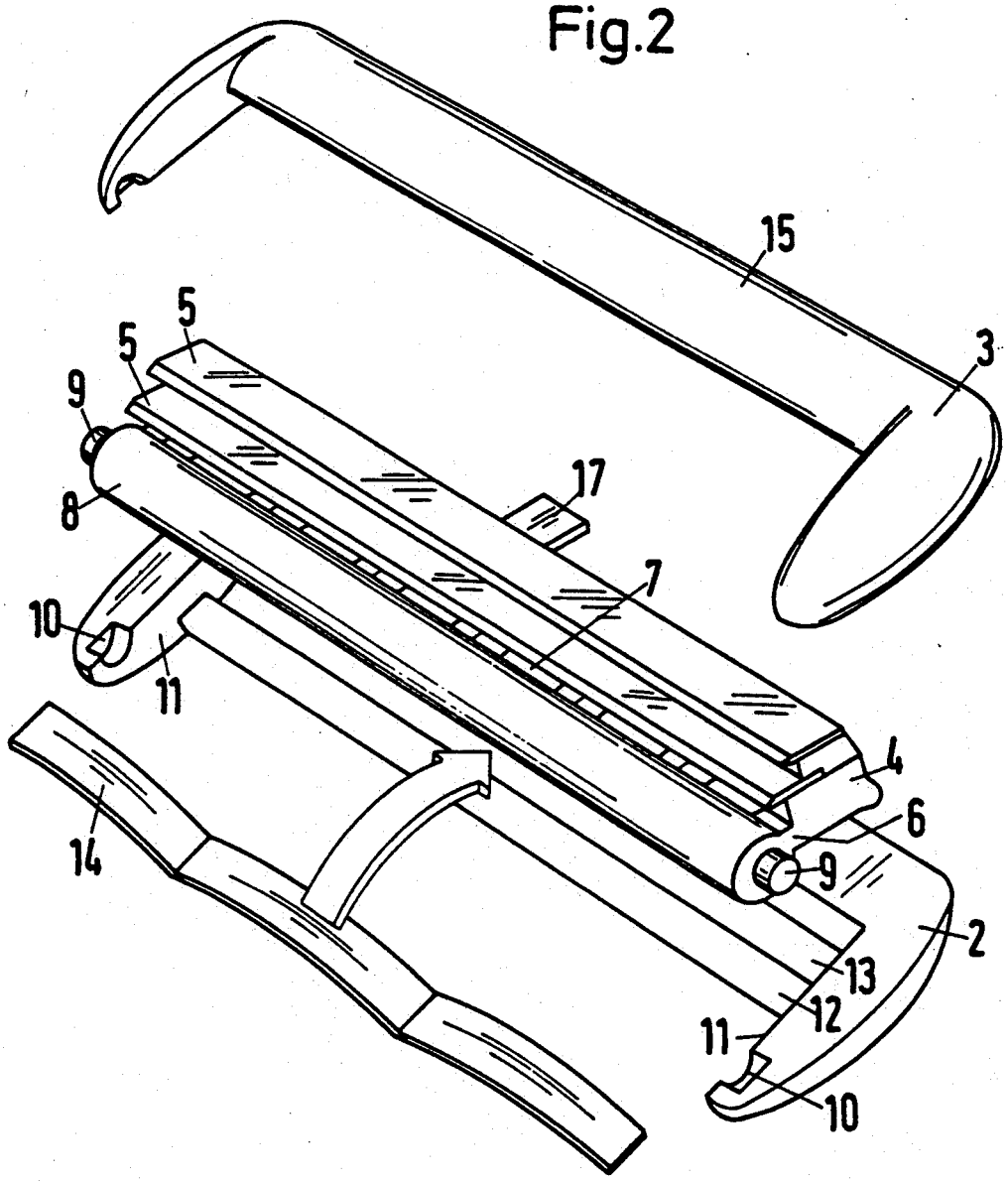
FIG. 2 is an exploded view showing the razor blade unit of FIG. 1 prior to assembly.
Figure 3:
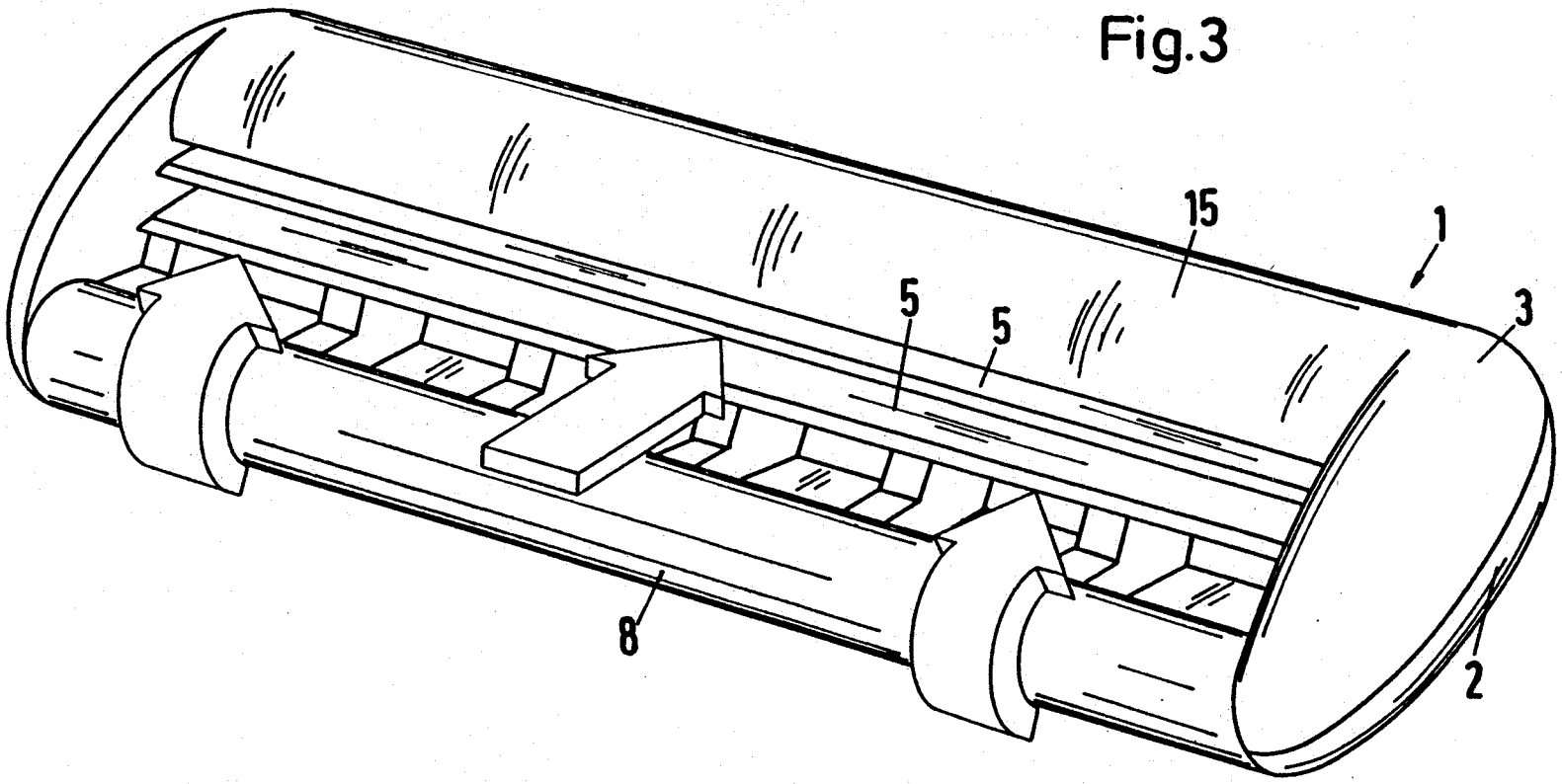
FIG. 3 is a view similar to FIG. 1, but indicates the possibilities for movement.
Figure 4:
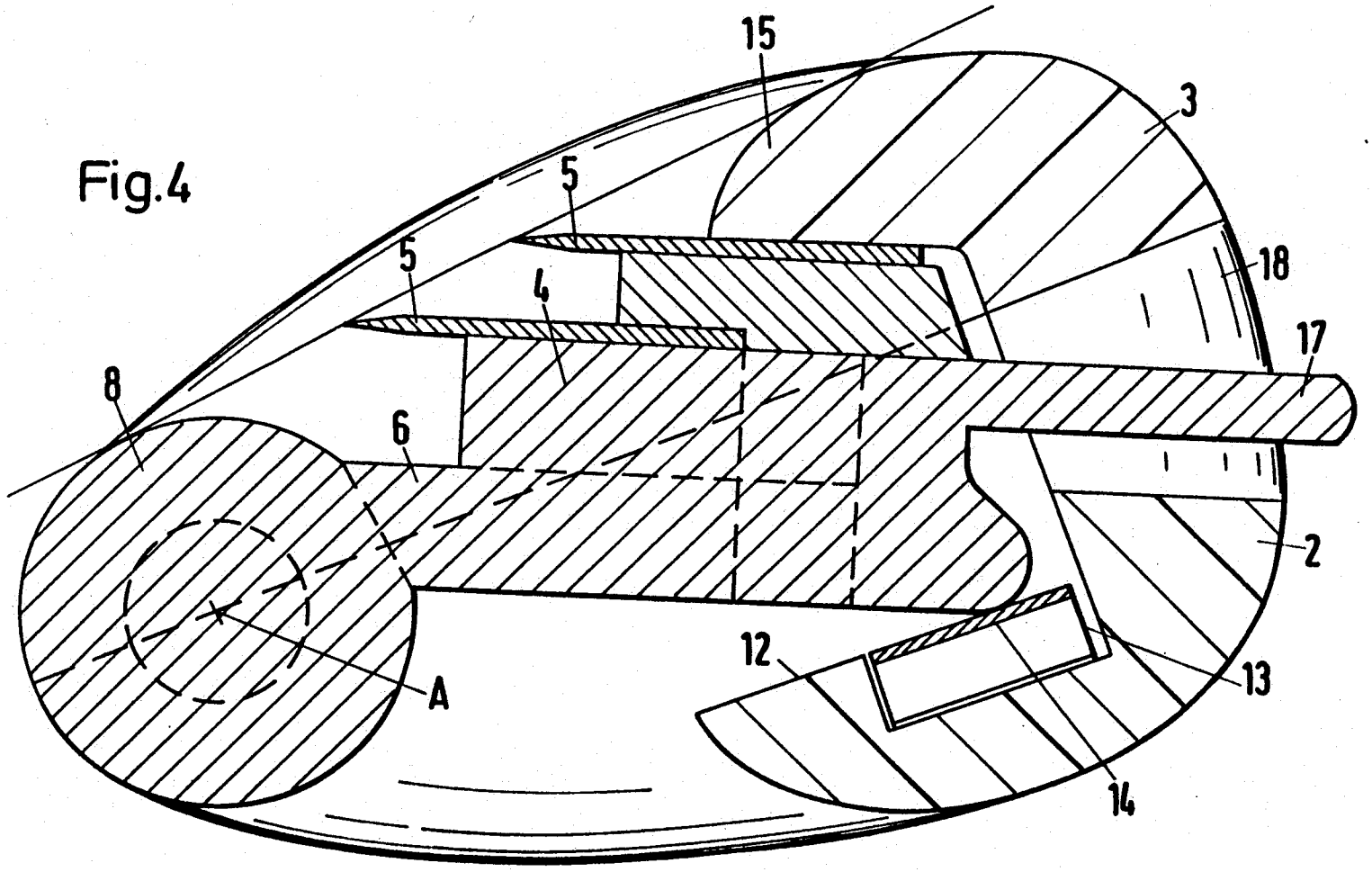
FIG. 4 is a cross-sectional view through the razor blade unit of FIG. 1 in the normal or starting position.
Figure 5:
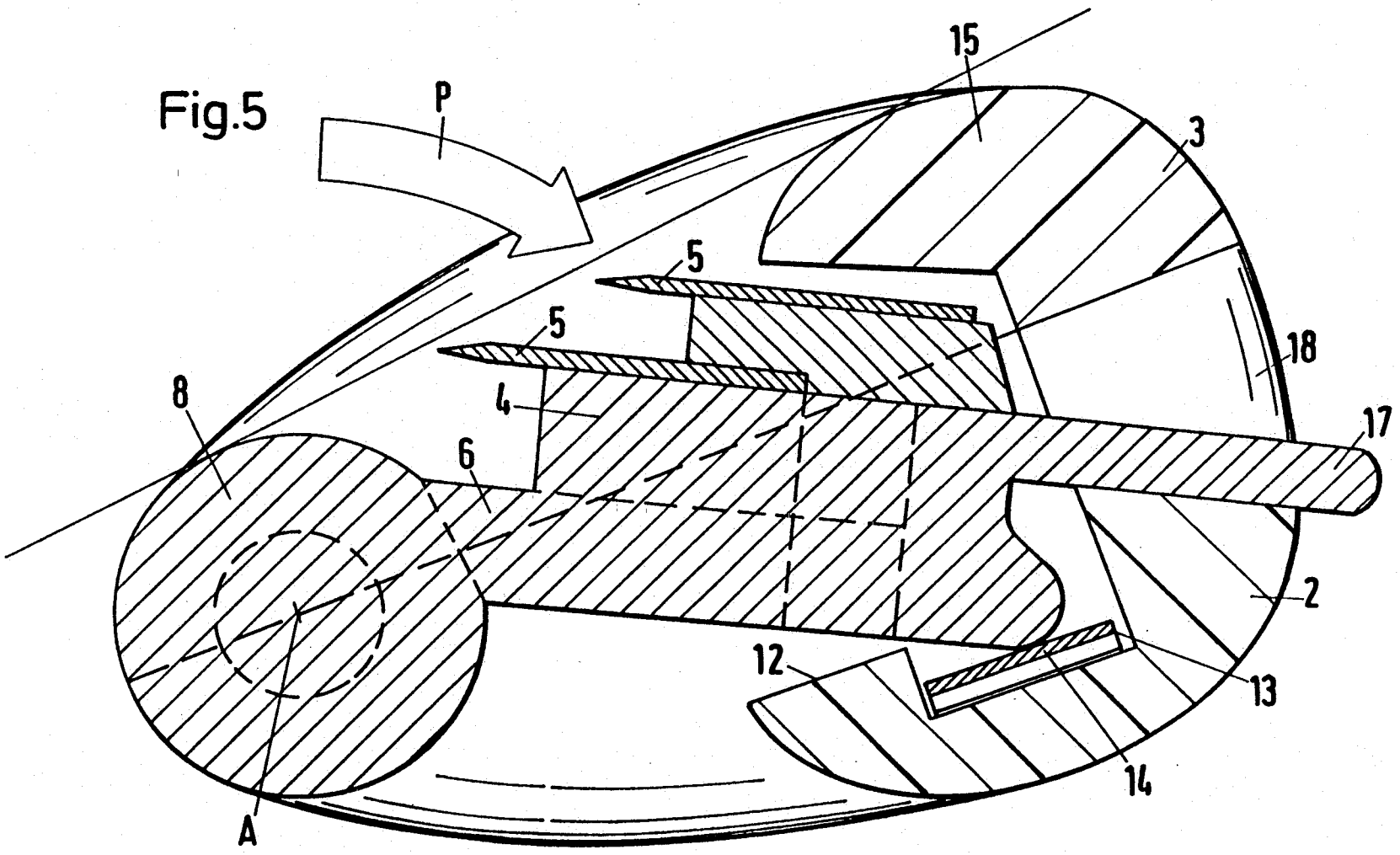
FIG. 5 is a cross-sectional view of the razor blade unit of FIG. 1 but in the pivoted position.
Figure 6:
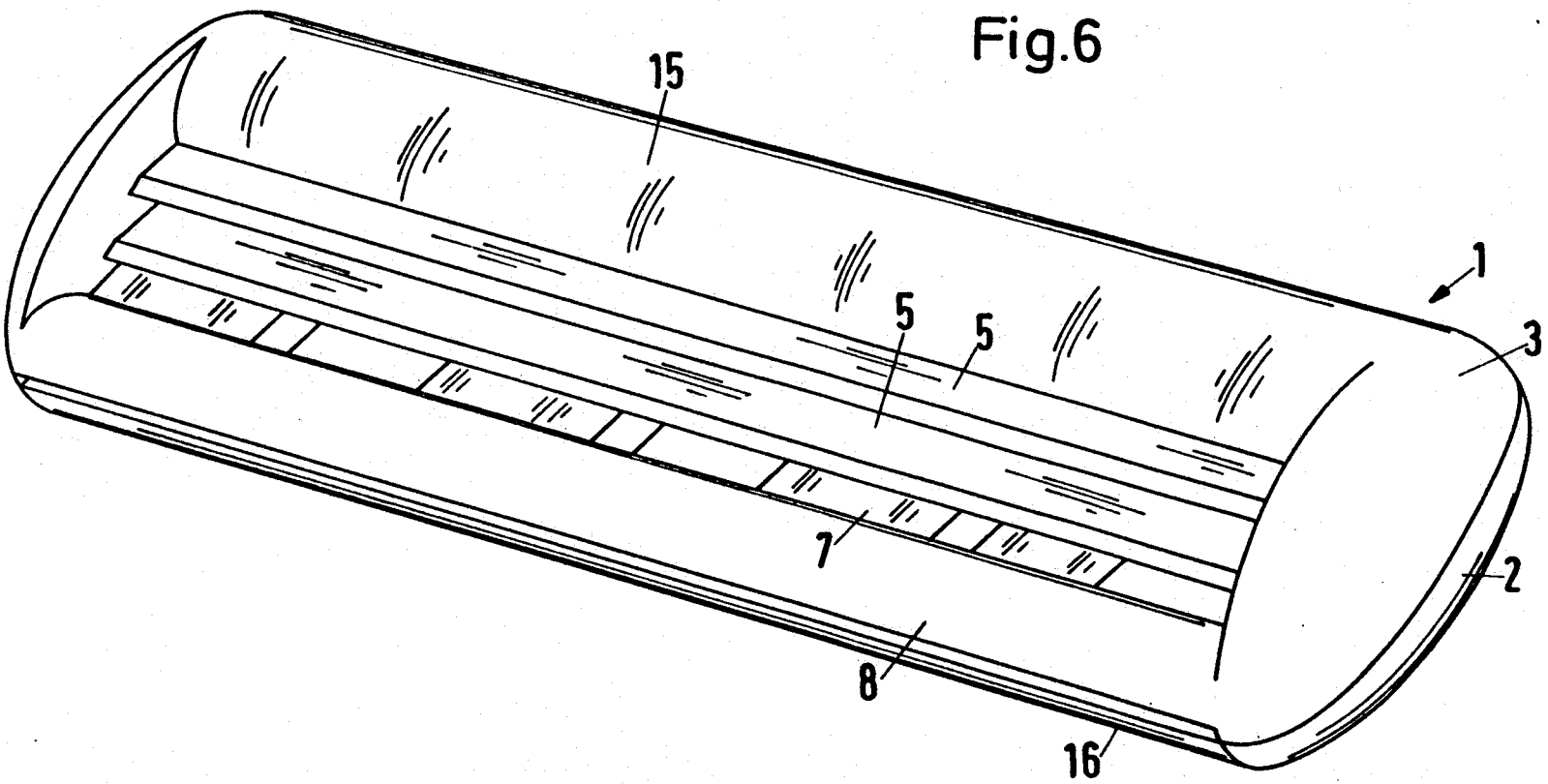
FIG. 6 is a perspective view of a second exemplary embodiment of the inventive razor blade units.
Figure 7:
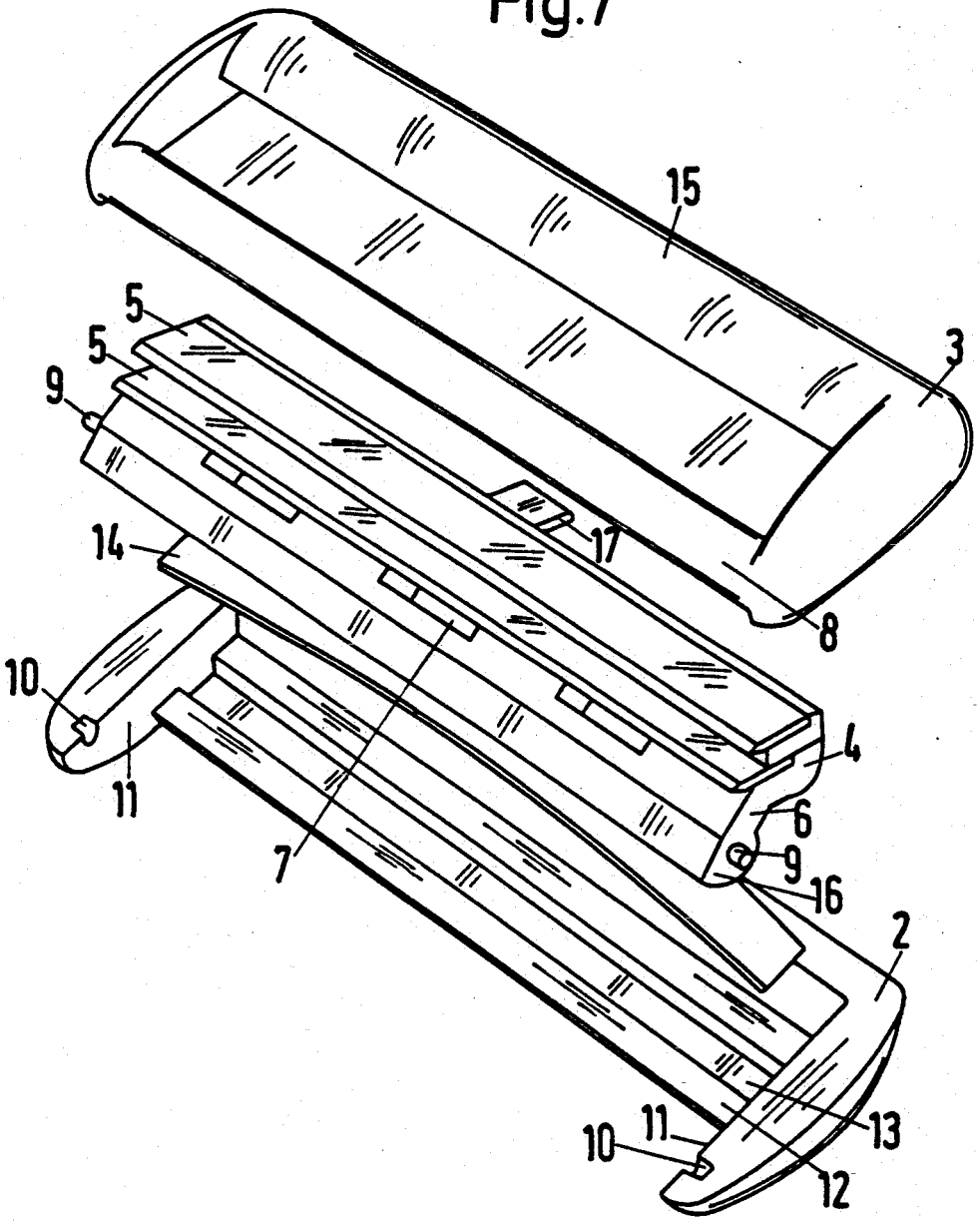
FIG. 7 is an exploded view showing the razor blade unit of FIG. 6 prior to assembly.
Figure 8:
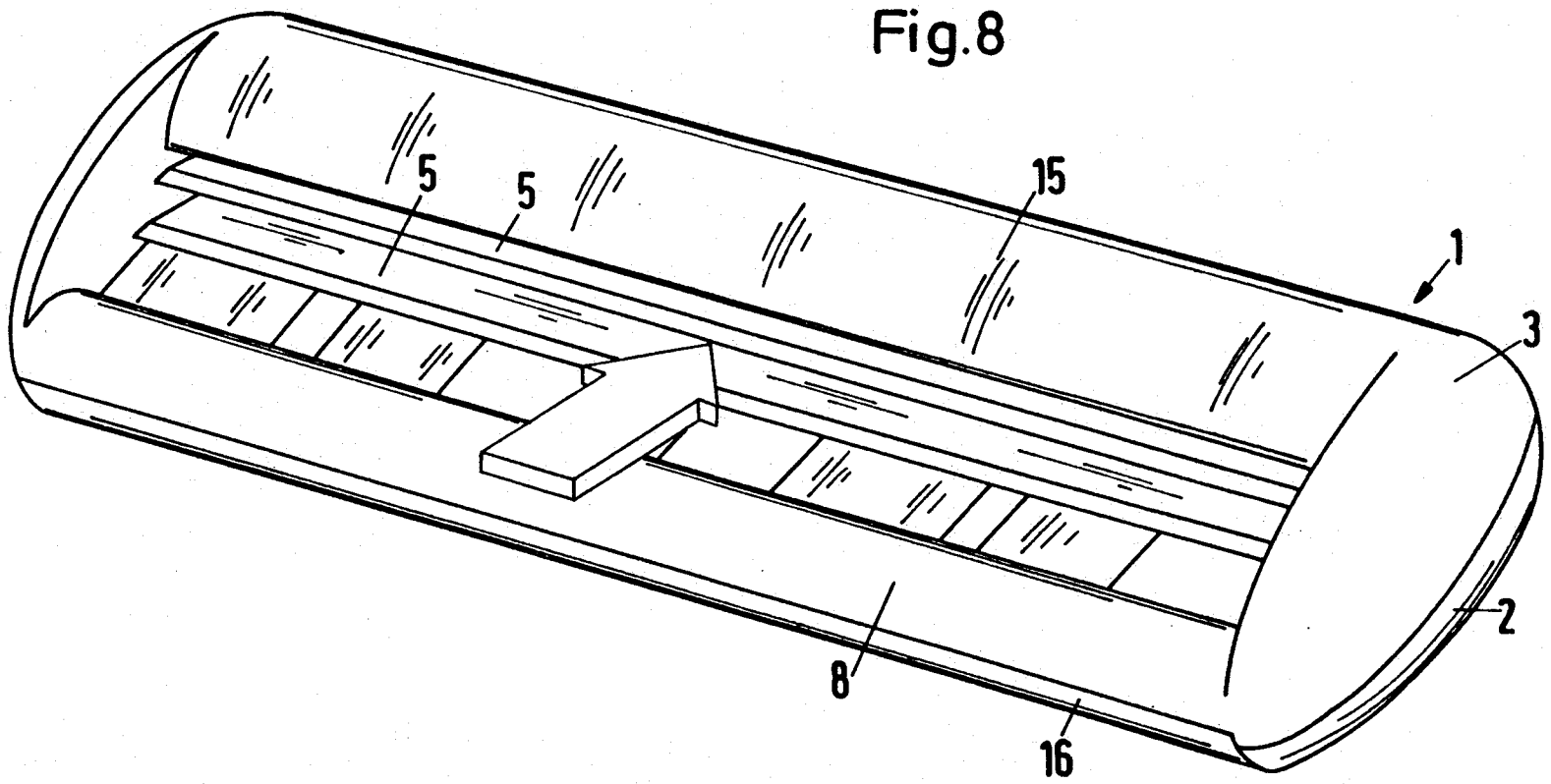
FIG. 8 is a view similar to FIG. 6, but indicates the possibilities of movement.
Figure 9:
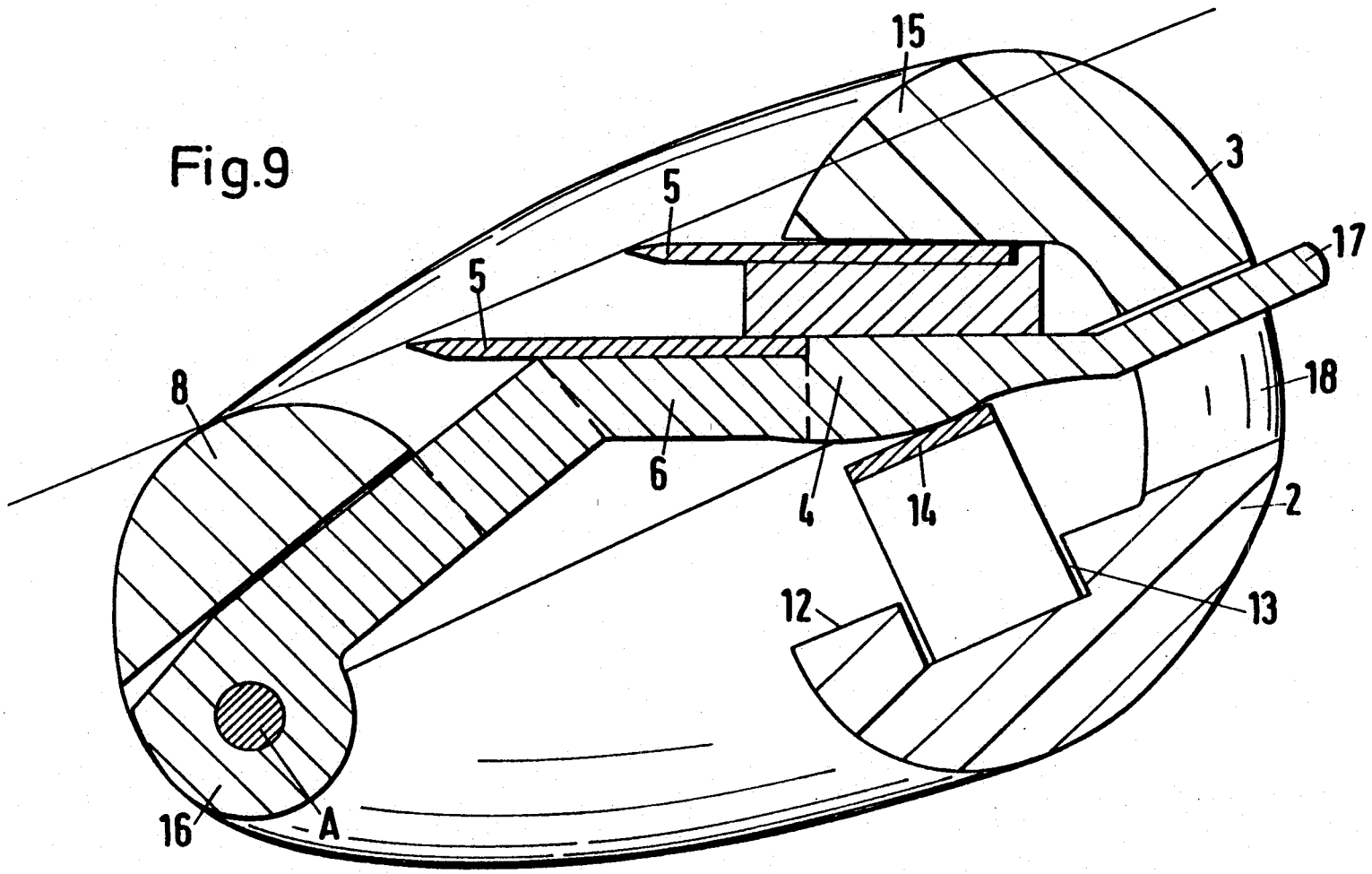
FIG. 9 is a cross-sectional view through the razor blade unit of FIG. 6 in the normal or starting position.
Figure 10:
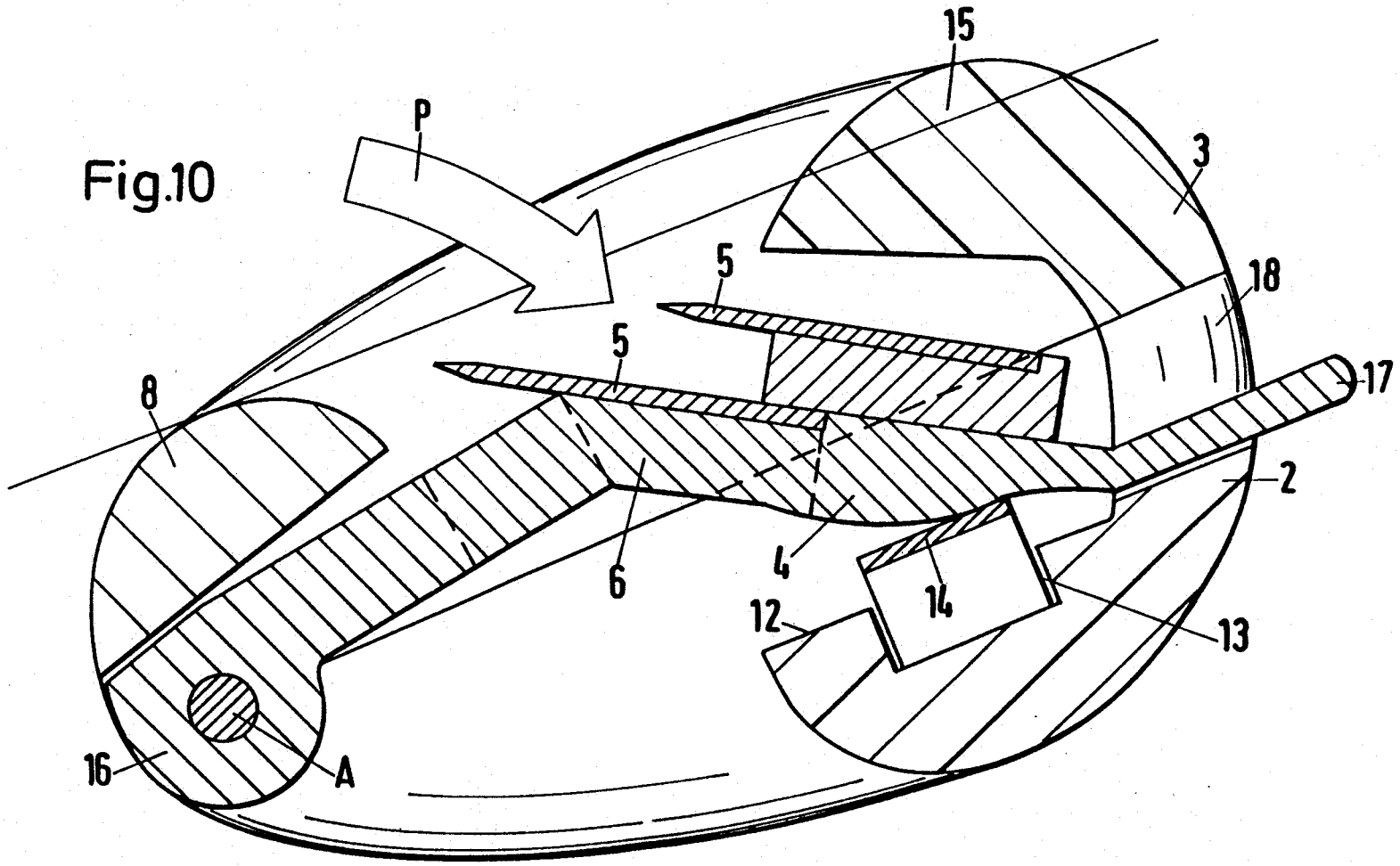
FIG. 10 is a cross-sectional view through the razor blade unit of FIG. 6 but in the pivoted position of the razor blades.

Furthermore, as can be seen from FIGS. 2, 4 and 5, the back side of the blade member 4 is provided with a projection 17 that is guided outwardly through an opening in the rear wall of the plastic housing 1. This opening 18 in the rear wall of the plastic housing 1 is formed by a recess on the upper side of the lower portion 2 that defines the opening 18 when the upper portion 3 is placed upon the lower portion 2. By means of this projection 17, the blade member 4 can be easily controlled or actuated from the outside, thereby considerably improving cleaning of the razor blades 5.

FIG. 4 shows the normal or starting position of the razor blade unit. In other words, the blade member 4 is in its uppermost position, where it rests against the underside or stop surface of the cap 15 and is pressed thereagainst by the compression spring 14. During a shaving process, pressure is applied to the blade member 4, with this pressure pivoting the blade member 4 against the force of the compression spring 14 into the interior of the plastic housing 1 about the axis A that is defined by the pins 9, as indicated by the arrow P in FIG. 5. This pivoting movement of the blade member 4 is enhanced in that during the shaving process, an appropriate torque is exerted upon the guide strip 8. Herein lies the essential concept of this exemplary embodiment of the present invention. In particular, the guide strip 8, which leads or precedes the razor blades 5, assumes an active role by transferring the frictional forces that occur while shaving onto the blade member 4 and pivoting the same. In this connection, the guide strip 8 can be provided with a structure or texture that ensures an optimum transfer of the forces encountered while shaving, with these forces being a function of the individual shaving conditions as well as of the shaving agents that are used. For example, the structure of the guide strip 8 can be a longitudinal grooving that extends parallel to the axis A.

A somewhat modified second exemplary embodiment is illustrated in FIGS. 6 to 10. This embodiment differs in two areas from the first embodiment.

Whereas with the first embodiment the guide strip 8 was rotatably or pivotably mounted within the plastic housing 1, with the second embodiment the actual guard or guide strip 8 is fixedly molded on the upper portion 3 of the plastic housing 1 and is hence stationary. To provide for a pivotable mounting of the blade member 4, an additional strip or bar 16 is provided that is similarly integrally connected to the blade member 4 via the connecting part 6. The ends of this strip 16 are provided with pins 9, via which the unit formed by the blade member 4, the connecting part 6 and the strip 16 is pivotably mounted within the plastic housing 1 in a manner corresponding to that explained in conjunction with the first embodiment.

The second difference between the two embodiments consists in the configuration of the compression spring 14. Whereas with the first embodiment the spring was a leaf-type spring that had several curved portions, with the second embodiment the spring, although it is also a leaf-type spring, has only a single curved portion, as can be seen in particular in FIG. 7.

The pivoting movement of the blade member 4 is effected in the same manner as with the first embodiment. In the normal or starting position (FIG. 9), the blade member 4 is pressed against the underside or stop surface of the cap 15 by the compression spring 14. At the same time, the upper side of the connecting part 6 rests flush against the planar underside of the guide strip 8. During a shaving process, pressure is applied that allows the blade member 4 to pivot downwardly, as indicated by the arrow P in FIG. 10. In the lowermost position, the flat upperside of the strip 16 rests against the under side of the guide strip 8 to thereby limit the movement of the blade member. As can be seen from the cross-sectional views of FIGS. 9 and 10, the planar upper side of the connecting part 6 is disposed at a slight angle relative to the planar upper side of the strip 16. It should be noted that with this second embodiment, the guide strip 8 does not assume an active role concerning the transfer of forces from the guide strip 8 to the blade member 4 during a shaving process.

The present invention is, of course, in no way restricted to the specific disclosure of the specification and drawings, but also encompasses any modifications within the scope of the appended claims.

What we claim is:

1. A razor head, especially a razor blade unit of a wet razor, with razor head being disposed at an end of a handle and comprising:

a plastic housing having a front guide strip;

a blade member to which blade means are secured, with said blade member being pivotably and yieldingly mounted in said plastic housing; and spring means disposed in said plastic housing for effecting said yielding mounting of said blade member, with said blade member being pivotable against a spring force of said spring means about an axis that extends parallel to said guide strip, wherein said blade member is fixedly connected to said guide strip to form a unit that is pivotable about said axis, which extends through said guide strip, and with said plastic housing including a cover means having a stop surface for limiting pivoting movement of an upper side of said blade member.

2. A razor head according to claim 1, wherein at least a portion of said guide strip that is intended for contact with the skin of a user during a shaving process has a preferably round cross-section configuration through the center of which said axis extends.

3. A razor head according to claim 1, wherein said guide strip is provided with a textured surface.

4. A razor head according to claim 1, wherein said guide strip has two ends, each of which is provided with a respective pin to effect pivotable mounting of said unit in side walls of said plastic housing.

5. A razor head according to claim 4, wherein said blade member has openings.

6. A razor head according to claim 1, wherein said plastic housing has a base, and wherein said spring means is a compression spring and is disposed between said base and said blade member.

7. A razor head according to claim 1, wherein said plastic housing comprises a lower portion and an upper portion that assemble together, with said blade member being disposed between said lower and upper portions as a separate component.

8. A razor head according to claim 1, wherein a rear side of said blade member is provided with a projection that is guided outwardly through an opening in a rear wall of said plastic housing.

9. A razor head, especially a razor blade unit of a wet razor, with said razor head being disposed at an end of a handle and comprising:

a plastic housing having a front guide strip;

a blade member to which blade means are secured, with said blade member being pivotably and yieldingly mounted in said plastic housing; and spring means disposed in said plastic housing for effecting said yielding mounting of said blade member, with said blade member being pivotable against a spring force of said spring means about an axis that extends parallel to and in the vicinity of said guide strip, wherein said blade member is fixedly connected to a further strip to form a unit that is pivotable about said axis, which axis extends through said further strip, which further strip is disposed below said guide strip, which guide strip is fixed on said plastic housing, and with said plastic housing including a cover means having a stop surface for limiting pivoting movement of an upper side of said blade member.

10. A razor head according to claim 9, wherein said further strip has a preferably partially round cross-sectional configuration through the center of which said axis extends, with an outer surface of said configuration forming an essentially continuous transition relative to said guide strip.

11. A razor head according to claim 9, wherein said further strip has two ends, each of which is provided with a respective pin to effect pivotable mounting of said unit in side walls of said plastic housing.

12. A razor head according to claim 11, wherein said blade member has openings.

13. A razor head according to claim 9, wherein said plastic housing has a base, and wherein said spring means is a compression spring and is disposed between said base and said blade member.

14. A razor head according to claim 9, wherein said plastic housing comprises a lower portion and an upper portion that assemble together, with said blade member being disposed between said lower and upper portions as a separate component.

15. A razor head according to claim 9, wherein a rear side of said blade member is provided with a projection that is guided outwardly through an opening in a rear wall of said plastic housing.

* * * * *